US006793574B1

(12) United States Patent
Robinson

(10) Patent No.: US 6,793,574 B1
(45) Date of Patent: Sep. 21, 2004

(54) VENT WITH PRESECURED MECHANICAL FASTENERS

(75) Inventor: Larry Dwight Robinson, Taylorsville, MS (US)

(73) Assignee: Solar Group, Inc., Taylorsville, MS (US)

( * ) Notice: Subject to any disclaimer, the term of this patent is extended or adjusted under 35 U.S.C. 154(b) by 0 days.

(21) Appl. No.: 10/600,397

(22) Filed: Jun. 20, 2003

(51) Int. Cl.[7] ..... F24F 7/02
(52) U.S. Cl. ..... 454/365; 454/364; 52/199
(58) Field of Search ..... 454/364, 365, 454/366; 52/198, 199

(56) References Cited

U.S. PATENT DOCUMENTS 4,280,399 A * 7/1981 Cunning ..... 454/365
4,817,506 A * 4/1989 Cashman ..... 454/365
5,009,149 A * 4/1991 MacLeod et al. ..... 454/365
5,022,203 A * 6/1991 Boyd ..... 52/199
5,095,810 A 3/1992 Robinson
5,457,920 A * 10/1995 Waltz ..... 52/199
5,458,538 A * 10/1995 MacLeod et al. ..... 454/365
5,704,834 A * 1/1998 Sells ..... 454/365
5,772,502 A * 6/1998 Smith ..... 454/365
6,277,024 B1 * 8/2001 Coulton ..... 454/365
6,371,847 B2 * 4/2002 Headrick ..... 454/365
6,598,353 B1 * 7/2003 Reeves ..... 52/57
6,623,354 B2 * 9/2003 Morris et al. ..... 454/365
6,684,581 B2 * 2/2004 Robinson et al. ..... 52/198

* cited by examiner

*Primary Examiner*—Derek S. Boles
(74) *Attorney, Agent, or Firm*—Arnold B. Silverman; Eckert Seamans Cherin & Mellott, LLC

(57) ABSTRACT

A vent which is attachable but not attached to a structure includes a body having openings for passage of air therethrough while resisting undesired entry of foreign matter. The body has a plurality of fastener receiving passageways. Passageways have an entry end and an exit end and fasteners extend into the passageways for retention therein prior to securement of the vent to the structure. The passageways are preferably composed of a resilient material and the passageway opening has at least portions of lesser opening size than the average diameter of the shank of the fasteners such as nails. In another embodiment, the passageways may be composed of a suitable metal. The passageway may have radially inwardly projecting portions which define a generally triangular segmented surface for retention of the fastener. The vent may be a roof ridge ventilator or other type of vent. The ventilator with the preattached fasteners may be shipped to the ultimate installation site in this manner thereby eliminating the need for the installer to separately handle and position each nail.

22 Claims, 5 Drawing Sheets

VENT WITH PRESECURED MECHANICAL FASTENERS

BACKGROUND OF THE INVENTION

1. Field of the Invention

This invention relates to a vent, as defined herein, having portions provided with fastener receiving passageways within which the fasteners are provided prior to positioning of the vent adjacent to a structure and securement thereof to the structure by said fasteners. More specifically, the vent is provided with a plurality of said fastener receiving passageways with suitable fasteners, such as nails, extending into the same such that the installer need merely position the vent in the desired location and hammer the nails into the underlying substrate in order to secure the vent in the desired position.

2. Description of the Prior Art

It has long been known to provide vents in connection with residential buildings, commercial buildings and other structures in order to exhaust air therefrom into the surrounding atmosphere. Such vents may be power operated by a suitable motor operating a fan or may be subjected to motion by prevailing winds and pressure differentials. Also, some vents have moving parts and others are fixed. In essentially all of prior art vents there is an opening in a wall or roof of the structure with the vent so configured as to provide openings for passage of exhausting air therethrough while resisting entry of undesired rain, snow, sleet, hail, insects, birds and animals.

Typically, such vents are secured to the structure employing preformed holes in a base portion with nails or screws which pass through the openings in the vent portion and into the substrate to provide effective mechanical securement. Alternatively, the nails or screws may penetrate the product material without employing preformed holes. Appropriate flashing to resist leakage around the vent and into the structure are also provided.

It has been known to make such vents out of various materials which have adequate strength, weather resistance, sun resistance and any other properties desired for the particular installation. Various resinous plastic materials such as polypropylene copolymers, for example, may be employed in vents as may suitable metals, such as aluminum or galvanized steel.

In instances where the vent is to be nailed it has been a general practice to have the vent positioned in the desired location in contact with the structure and to have the roofer or other installer have a supply of nails which are individually sequentially positioned at the place where it is to be driven through the vent and into the substrate with hammering action resulting in driving the nail into its final position. This is done sequentially with the plurality of nails required to hold a particular vent.

An example of a type of vent which has been anchored in this manner is a roof ridge vent which is assembled from a plurality of elongated panels which overlie an opening at the apex of the roof and extend angularly downwardly on both sides thereof. The roof ridge vent typically has a longitudinal extent such that a plurality of individual panels are secured in side-by-side relationship and are interengaged. Such roof vents are shown in U.S. Pat. No. 5,095,810 and U.S. Patent application Ser. No. 09/772,611, (now U.S. Pat. No. 6,684, 581), the disclosures of both of which are incorporated herein by reference.

There remains, therefore, a very real and substantial need for a vent which is easier to install employing mechanical fasteners.

SUMMARY OF THE INVENTION

The present invention has met the above described needs by providing a vent which is attachable to, but not attached to a structure. The vent has a body with openings for passage of air therethrough and is so structured as to resist undesired entry of foreign matter into the structure through the opening which is operatively associated with the vent. The body has a plurality of tubular elongated fastener receiving passageways which have an entry end and an exit end and fasteners, which may be nails, extending into at least some of the passageways for retention therein prior to the vent being secured to the structure.

The passageway dimensions are preferably such that the nail retained therein will have an interference fit and resist undesired relative separation. The vent may be delivered to the job site with the fasteners, such as nails, in position for securement of the vent to the structure by hammering thereby eliminating the need to handle the nails individually by the installer prior to securement of the vent to the structure.

The fasteners preferably extend more than half way through the axial extent of the passageway and, most preferably, substantially entirely to the distal end of the passageway without extending therebeyond. The vent may, for example, be a ridge roof vent having a generally V-shape with the apex overlying a ridge opening in the roof and panel portions extending generally downwardly therefrom on both sides with depending spacers and deflectors serving to resist the entry of foreign matter into the building through the building opening. The passageways may be integrally formed as by molding and may depend downwardly so as to extend between the undersurface of the panel and the upper surface of the roof.

It is an object of the present invention to provide a vent for a structure which has presecured fasteners which may be employed to secure the vent to the building without requiring individual handling of the nails at the job site.

It is a further object of the present invention to provide such a product wherein the nails may be presecured within specifically positioned passageways at the place of vent manufacture and delivered to the work site without loss of fasteners or undesired excess penetration of the fasteners through the passageway.

It is another object of the present invention to provide such a product which does not interfere with the preexisting functioning of the ventilator once installed.

These and other objects of the invention will be more filly understood from the following description of the invention with reference to the illustrations appended hereto.

DESCRIPTION OF THE PREFERRED EMBODIMENTS

As employed herein, the term "vent" means a ventilator or ventilator panel or other component which is structured to be secured to or adjacent to an opening in an exterior portion of a structure to facilitate exhaust of air therefrom and shall expressly include static and movable ventilators, powered and unpowered ventilators and shall also include, but not be limited to residential and commercial roof and wall ventilators.

As employed herein the term "foreign matter" means rain, snow, sleet, hail, airborne solids and birds, squirrels, roaches, wasps or other flying insects. While it will be appreciated that the present invention may be employed effectively with a wide variety of vents, for purposes of disclosure herein specific focus will be placed upon panels which form a unit of roof ridge ventilators.

Figure 1:
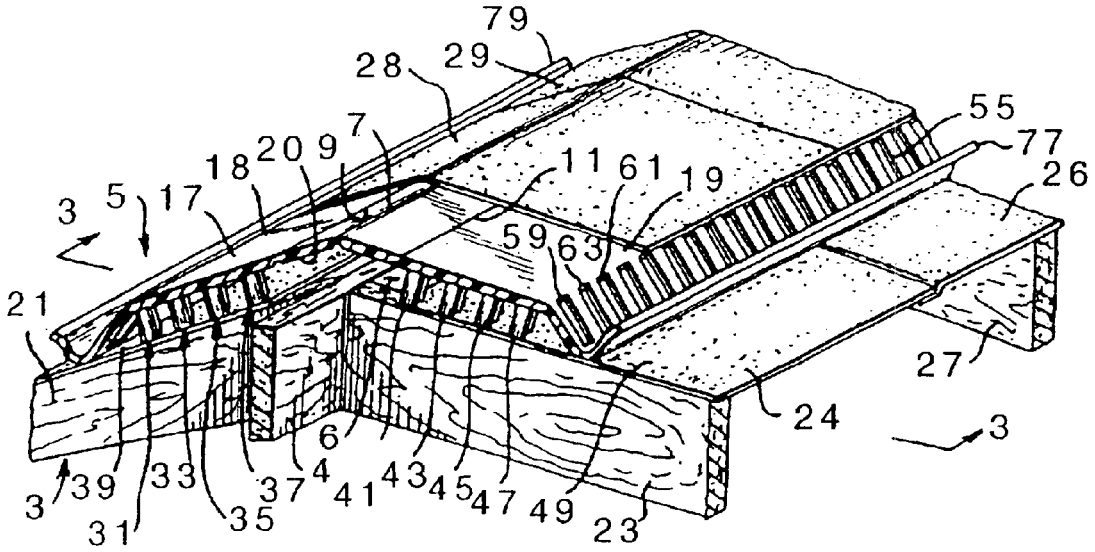
FIG. 1 is an isometric drawing of a prior art ridge vent assembled on a roof peak with capping shingles attached to the ridge vent.
Figure 2:
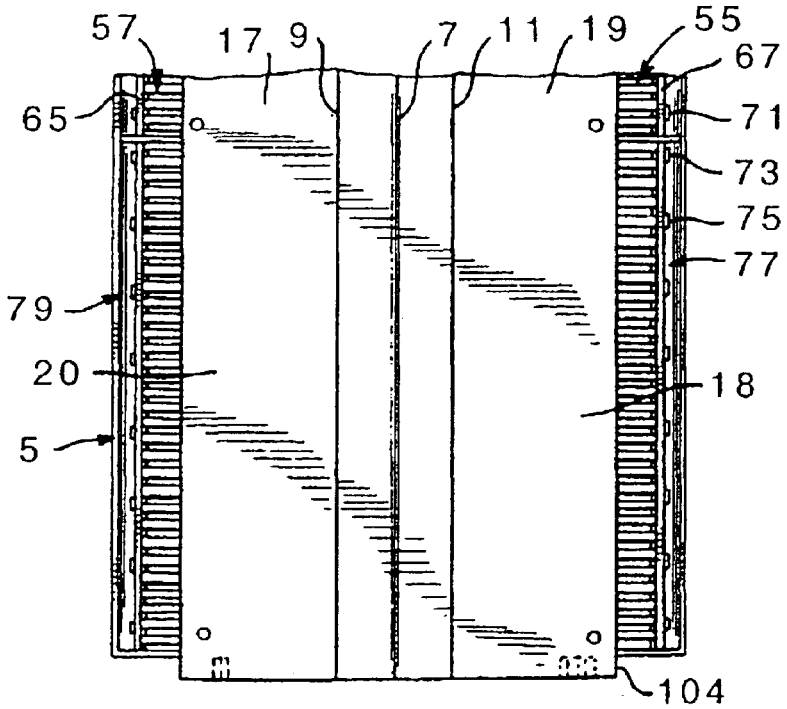
FIG. 2 is a top plan view of a portion of a prior art ridge vent usable with the present invention.
Figure 3:
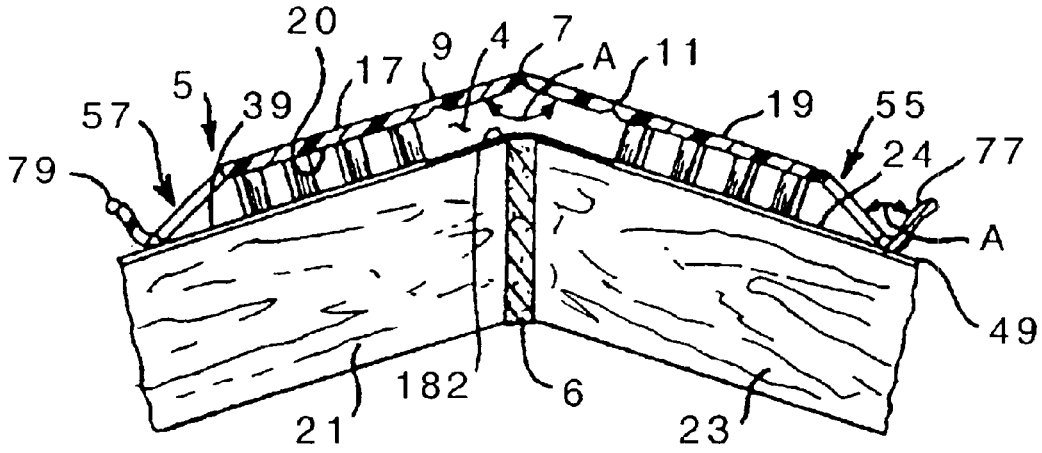
FIG. 3 is a cross-sectional illustration through 3—3 of FIG. 1.

Referring now to FIGS. 1 through 3, roof portion 3 has opening 4 which is above the main beam 6 of the roof 3. Cross-beams such as 21 and 23 are joined to main beam 6 to form the structural support for the roof 3. A plurality of cross-beams exist along the roof at spaced intervals. The cross-beams 21 and 23 and the next cross beam 27 support plywood decking (not visible) onto which shingles such as shingles 24 and 26 are affixed. The shingles 24 and 26 stop short of the main beam 6 so that a gap exists over which the ridge vent of the present invention is placed. More specifically, between each set of cross-beams 21, 23 and 27, openings such as opening 4 exist to allow air to pass into the building space. In accordance with the present invention, ridge vent 5, which is preferably composed of plastic as discussed hereinafter, is placed over the opening 4 in roof 3 in order to allow for ventilation of the underlying space while resisting entry of weather, insects, birds, and the like. Capping shingles 28 and 29 are placed over ridge vent 5 to complete the roof as discussed hereinafter. Ridge vent 5 is composed of panel portion 17 which is angularly disposed with respect to panel portion 19. Panel portions 17 and 19, are, in a preferred form, of unitary construction. More specifically, the entire ridge vent 5 is preferably initially a flat object composed of panel portions 17 and 19 which are then bent at hinges 7, 9 and 11 to conform to the peak of roof 3 and to form a substantially smooth curved surface to support capping shingles 28 and 29. Alternatively, panel portions 17 and 19 may be constructed separately and then joined in an angular configuration.

In the preferred embodiment, panel portions 17 and 19 are a flat unitary piece which can be bent at hinges 7, 9 and 11. Hinges 7, 9 and 11 in the form shown are integrally formed by thinner portions of the panel which are generally downwardly open (FIG. 3). Hinges 7, 9 and 11 form a three point hinge to allow a gradual curve rather than a sharp angle. Although FIG. 3 shows the bend at hinge 7 to be a distinct angle, it is noted that it may be preferred in the application to provide additional bending at hinges 9 and 11 to form a smoother curve which resists cracking of the overlapping capping shingles, such as shingles 28 and 29. The hinges 7, 9 and 11 are also provided to accommodate use of the ridge vent 5 with roofs having peaks which are angled differently.

Panel portions 17 and 19 are composed of cover surfaces 18 and 20, respectively (FIG. 2). Cover surfaces 18 and 20 face towards the atmosphere and the capping shingles 28 and 29 are placed over the cover surfaces 18 and 20 when the roof 3 is completed. Additionally, panel portion 17 and the panel portion 19 have interior surfaces. Interior surfaces 32 and 34 face into opening 4 in the roof 3.

Panel portion 17 of ridge vent 5 is supported on roof 3 by a plurality of generally V-shaped baffles, such as baffles 31, 33, 35 and 37 which are visible in FIG. 1. Panel portion 19 is similarly supported by a plurality of generally V-shaped baffles, such as baffles 41, 43, 45 and 49 which are visible in FIG. 1. The generally V-shaped baffles 31 through 37 protrude from the underside of panel portion 17 generally along an axis normal to the plane portion 17. Baffles 31 through 37 directly contact shingles such as shingle 39 of roof 3 and support ridge vent 5 on roof 3. Similarly, generally V-shaped baffles 41 through 49 of panel portion 19 similarly contact shingles such as shingle 24 on roof 3 (FIG. 1).

Figure 4:
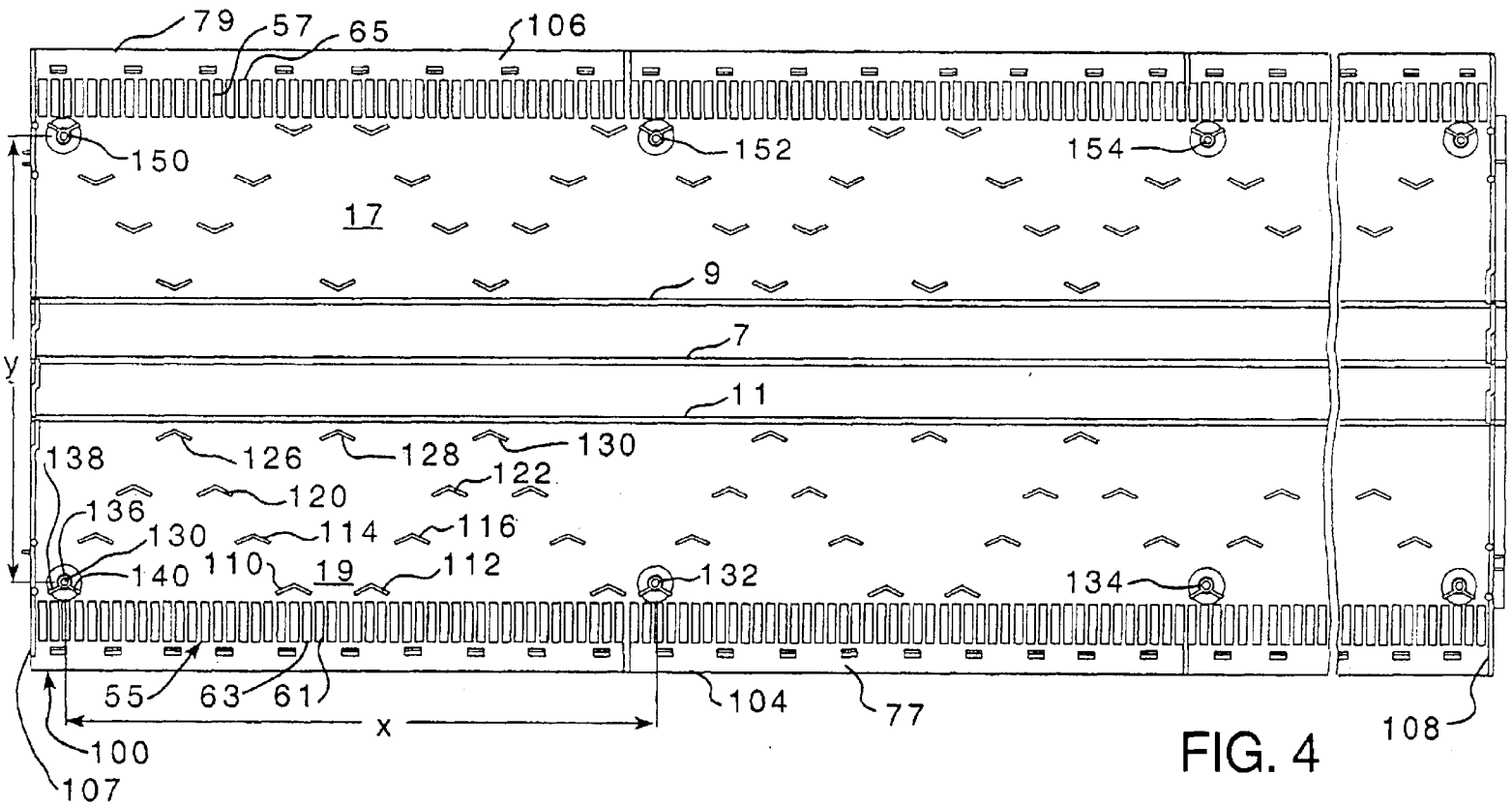
FIG. 4 is a bottom plan view of a section of a ridge vent employing features of the present invention.
Figure 6:
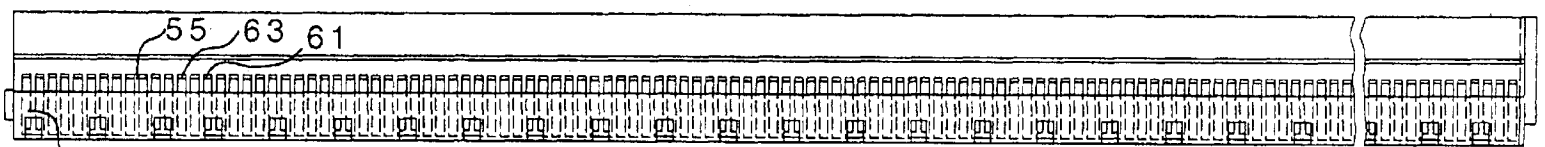
FIG. 6 is a front elevation of a ridge vent section of the present invention.
Figure 5:
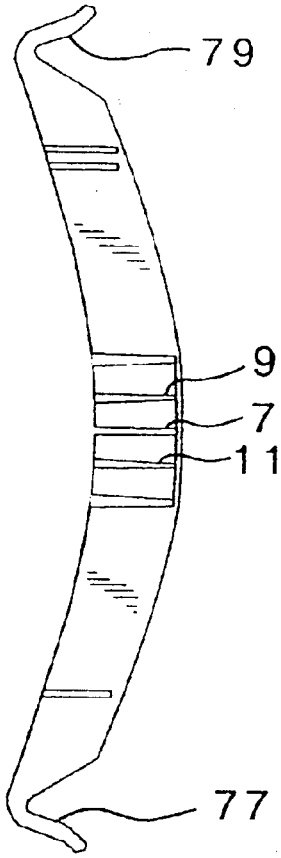
FIG. 5 is a left side elevation of the bottom plan view of FIG. 4.
Figure 7:
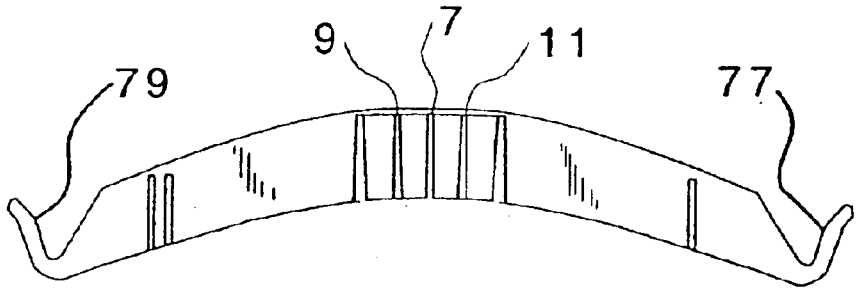
FIG. 7 is a left side elevation of the panel of FIG. 6.

Referring now to FIGS. 4 through 7 wherein like numbers will be employed for features present in FIGS. 1 through 3 and different numbers for modifications. provided by the present invention. The vent panel 100 shown in FIG. 4 has a pair of lateral edges 104, 106 and a pair of ends 107, 108. The first lateral edge 104 is adjacent to a plurality of openings such as 61, 63 disposed between ribs such as ribbing 55 on panel portion 19. Ribs such as 57 are adjacent to opening 65 on panel portion 17. Hinge portions 7, 9 and 11 are also shown in FIGS. 4 and 5.

A plurality of staggered generally V-shaped baffles being generally outwardly concave are integrally formed with the panels 17, 19. The staggering of baffles such as on panel 19, the row containing 110 and 112 with the row containing baffles 114, 116 and the row containing 120, 122 with the row containing baffles 126, 128, 130 results in a segmented array that resists entry into the building of foreign matter introduced through the openings in the array containing openings 61, 63. The baffles such as 110,112, 114, 116, 120, 122,126, 128, 130 project downwardly from the undersurface of panel 19 and have their free ends engage the roof surface. Of particular interest in the present context are the integrally formed vent openings such as baffle containing members 130, 132, 134 which have generally V-shaped arms formed by the passageway defining portion 136 and arms 138, 140 in 130 and similar structures in 132, 134. It will be appreciated that the passageways 130, 132, 134 are generally aligned longitudinally with the panel 100 and the line is generally parallel to lateral edge 104. Similarly, passageways 150, 152, 154 are generally in a line parallel to lateral edge 106.

The center-to-center spacing between two aligned passageways such as 130, 132 will be whatever is desired for the structural integrity of the assembled ventilator structure and provide the necessary "net free area" or unobstructed ventilation opening(s), while maintaining a deterrent to weather infiltration. In the form shown in FIG. 4, the passageways 130, 132, 134 of one line are aligned with the corresponding passageways 150, 152, 154 of the other line. In a preferred embodiment the distance x center-to-center between aligned passageways in the same line is about 10 to 14 inches and between aligned passageways in different lines y will preferably be about 9 to 11 inches.

It is preferred that the passageway such as 134 be spaced from the closest adjacent lateral edge such as 104 by about 1 to 2 inches and that it be spaced a minimum of about ¾ inch from the end such as 107.

Figure 8:
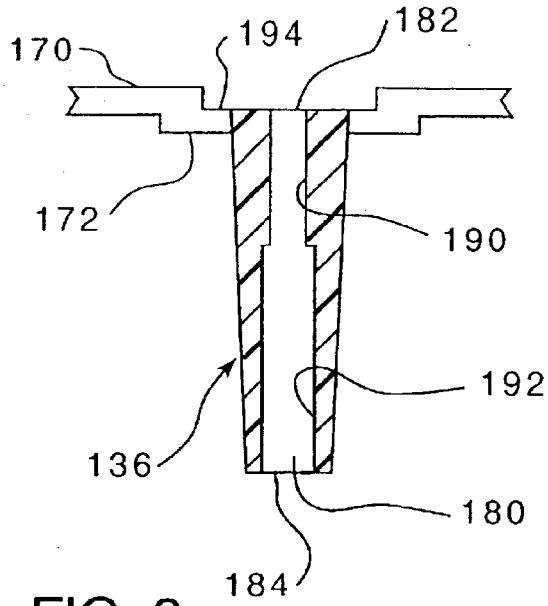
FIG. 8 is a cross-sectional illustration of a fastener receiving passageway of the present invention.
Figure 9:
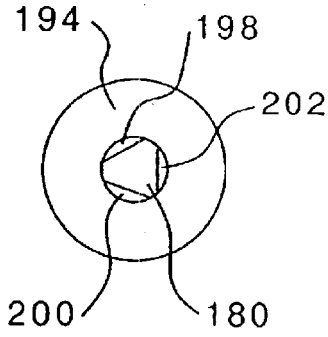
FIG. 9 is a top plan view of the passageway of FIG. 8.
Figure 10:
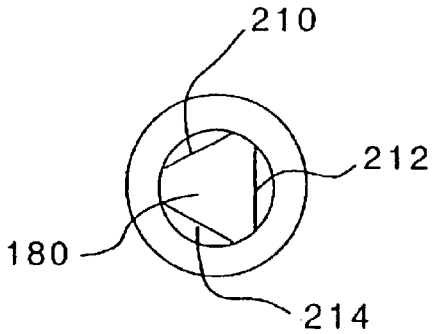
FIG. 10 is a bottom plan view of the passageway of FIG. 8.

Referring to FIGS. 8 through 10, it is seen that the body of the panel 100 has an upper surface 170 and a lower surface 172 as shown in FIG. 4 with the passageways 130, 132, 136 as shown in FIG. 8 projecting downwardly from the panel or upwardly in the bottom plan view shown in FIG. 4. It has a throughbore 180 with an entry end 182 and an exit end 184. A first portion has a first opening 190 and a second portion has a second opening 192 which is greater than the first opening. As shown in FIGS. 8 and 9 the upper portion of the passageway terminates in a counterbore 194 which is proportioned to receive a nail head so as to cause the upper surface of the nail to be generally flush with upper surface 170. The opening 180 in the passageway has a plurality of radially inwardly projecting elements 198, 200, 202 which define a generally triangular upper opening section 190. Similarly, the second or lower portion of opening 180 has inwardly projecting elements 210, 212, 214 which define a generally triangular opening 192. It will be appreciated that the absence of continuity circumferentially in the surfaces defining bore or opening 180 provide less frictional resistance to introduction of a fastener such as a nail into the opening 180. The inwardly projecting elements 198, 200, 202 and 210, 212 214 could be merged with each other to provide a continuous elongated group of radial restrictions or could be separated axially from each other.

In a preferred embodiment the passages will be made of a resinous material such as a polyolefin such as a polypropylene copolymer or other suitable moldable material unit and will be formed as a unit with the panel 100. The material of the passageway such as 134 will be resilient such that it maybe employed with a nail having a shank diameter greater than the opening 180 thereby providing for any effective interference fit which will resist undesired withdrawal of the nail from the passageway.

Figure 11:
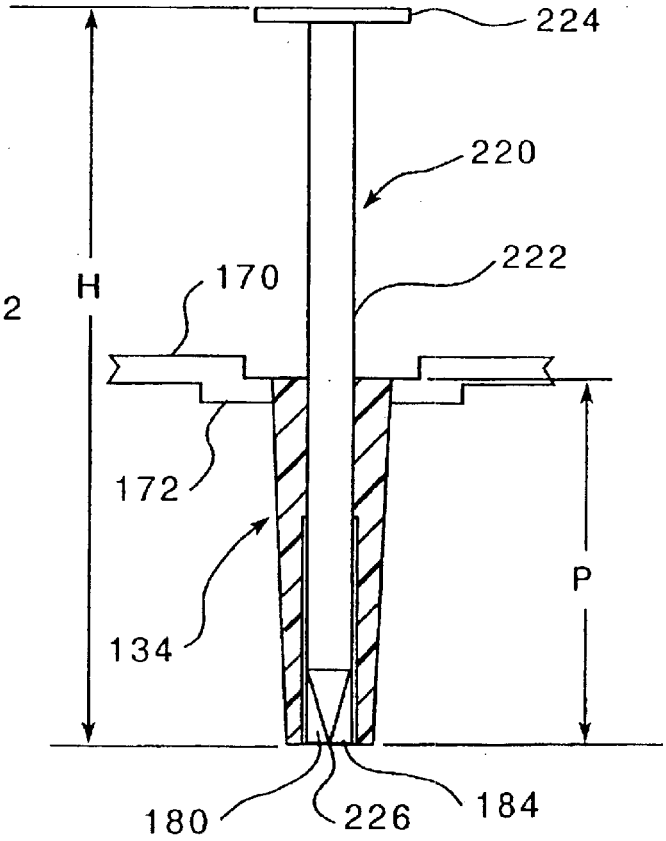
FIG. 11 is a cross-sectional illustration showing a fastener interengaged with a passageway.

Referring to FIG. 11 there is shown a nail 220 having a shank 222, a nail head 224 and a pointed leading end 226. In the form shown the nail has a height H substantially greater than the height P of the bore 180 such that even when the nail is fully inserted so that its distal end 226 is adjacent to the exit end 184 of the passageway 134, a substantial portion of the nail 220 projects above the uppermost portion or the entry end 182 of the passageway thereby permitting hammering of the nail up to the length of the nail portion disposed between the passageway entry end 182 and the underside of the nail 224 once the vent has been placed in position adjacent to the structure.

In a preferred embodiment the length of the passageway P will be about 30 to 60 percent of the length of the total height of the nail H. In order to achieve the desired interference fit it will be desired that the defined passageway as shown best in FIG. 8, in the first section 190 will have a cross section slightly less than the average shank diameter of the nail. For example, the first portion 190 of the passageway 134 may have an opening defined among the radially inwardly projecting portions 198, 200, 202 of about 0.115 inch and the average nail shank diameter may be about 0.125 inch. This facilitates relative ease of insertion of the nail to effect an interference fit which will resist the nail coming out during shipping or handling.

In the form shown in FIG. 11, for example, the nail may have a total length of 2 inches, a diameter of ⅛ inch and a head diameter of ⅜ inch such that with a passageway having a total length of a 1 1/16 inch the nail will protrude above the passageway about one inch. This will result in the nail penetrating completely through the underlying roof decking in conventional roofs.

In view of the extensive projection of the fastener such as a nail and the geometric shape of the example of the ridge roof shown in the present disclosure there will be adequate clearance during shipping and handling so as to eliminate the risk of undesired deformation of the nails. Such panels may be stacked without interfering with the nail prepositioning.

It will be appreciated that the present invention facilitates insertion of nails at the factory or at any location prior to physically placing the vent adjacent to the structure in the location where it would anchored. The installer, therefore, does not have to go through the tedious and, perhaps, dangerous and inefficient practice of individually sequentially grasping a nail, placing it in the desired position and holding the nail while initiating penetration of the nail into the roof. With the present system one may merely position the vent in the desired location and sequentially hammer the prepositioned, presecured nails so as to achieve the desired intimate securement in a highly efficient, safe and rapid manner.

While for convenience of disclosure herein emphasis has been placed on an example of a roof ridge vent it will be appreciated that the invention may be employed in other types of vents such as pot style roof vents and other vents molded of resinous materials.

The invention may also be used with vents made of suitable metals, such as aluminum or galvanized steel, for example. In such cases the passageways may have a length of about 10 to 70% of the length of the fastener.

If desired in lieu of the radially inwardly projecting portions 194, 198, 200 and 210, 212, 214 which have substantial circumferential extent, circumferentially narrow integrally formed vertically oriented fins may be employed.

While the disclosure has illustrated a bore 180 having an upper section 190 of smaller bore diameter than the lower section 192, if desired, the sections may be reversed with the upper section having a larger bore diameter than the lower section.

It will be appreciated that the present invention has provided a unique means for facilitating securement of a vent to a structure by presecuring nails at the desired locations in such a manner that the nails will neither be damaged nor separated from the vent during manufacture, shipping and handling. The invention has further provided the interference fit propositioning of nails such that the installer need merely position the vent in the desired location and hammer the nails in order to effect the desired mechanical securement of the vent to the building without having to engage in individual handling, positioning, initial insertion and completion as has been previously required for such installations. All of this is accomplished without having any detrimental effect on the design and functioning of the vent.

Whereas particular embodiments of the present invention have been described herein for purposes of illustration, it will be appreciated by those skilled in the art that numerous variations of the details may be made without departing from the invention as described in the appended claims.

What is claimed is:

1. A vent which is attachable, but not attached to a structure comprising a body having openings for passage of air therethrough while resisting undesired entry of foreign matter, said body having a plurality of tubular passageways for receipt of fasteners therein, said passageways having an entry end and an exit end, and fasteners extending into at least some of said passageways for retention therein prior to attachment of said vent to said structure.

2. The vent of claim 1 including said fasteners being nails.

3. The vent of claim 2 including said nails having a length greater than the length of said passageway into which it extends.

4. The vent of claim 3 including said nails extending more than one-half way into said passageways.

5. The vent of claim 4 including said nails extending into substantially the entire length of said passageways.

6. The vent of claim 5 including said nails not projecting substantially beyond the exit end of said passageways.

7. The vent of claim 3 including said passageways having a first section of a first opening size adjacent to said entry end, and said passageways having a second section with a second opening size adjacent to said exit.

8. The vent of claim 7 including said second opening size being larger than said first opening size.

9. The vent of claim 3 including said passageways having a generally triangular interior opening configuration.

10. The vent of claim 3 including a recess disposed adjacent to said entry end, and said recess receiving the head of a said nail.

11. The vent of claim 3 including said passageways having generally radially inwardly projecting portions in contact with said nail.

12. The vent of claim 7 including said body passageways composed of a resilient material, and said nails having an average shank diameter greater than said first section opening size.

13. The vent of claim 3 including said vent being a panel for an elongated roof ridge ventilator.

14. The vent of claim 13 including said ridge vent panels having a generally V-shaped web portion with two opposed lateral edges and two opposed ends and an upper surface facing toward the atmosphere and an inner surface, and said body passageways extending generally downwardly from said inner surface.

15. The vent of claim 14 including a first plurality of said body passageways extending generally in a line parallel to a first said lateral edge, and a second plurality of said body passageways extending generally in a line parallel to a second said lateral edge.

16. The vent of claim 15 including the center-to-center spacing between adjacent said passageways in a said line being about 10 to 14 inches.

17. The vent of claim 15 including the center-to-center spacing between a pair of adjacent said body passageways disposed in opposite said lines being about 9 to 11 inches measured along said web portion.

18. The vent of claim 3 including said nails having a total length substantially greater than the axial length of said body passageway.

19. The vent of claim 18 including said body passageways having a length of about 30 to 60 percent of the length of said nail.

20. The vent of claim 1 including said fasteners being in interference fit within said passageways so as to resist undesired separation of the fastener from the passageway.

21. The vent of claim 1 including said body passageways being composed of metal.

22. The vent of claim 21 including said body passageways having a length of about 10 to 70 percent of the length of said nail.

* * * * *

UNITED STATES PATENT AND TRADEMARK OFFICE

CERTIFICATE OF CORRECTION

PATENT NO. : 6,793,574 B1
DATED : September 21, 2004
INVENTOR(S) : Larry Dwight Robinson It is certified that error appears in the above-identified patent and that said Letters Patent is hereby corrected as shown below:

Column 2,
Line 52, “filly” should read -- fully --.

Column 4,
Line 28, “modifications. provided”, should read -- modifications provided --.
Line 45, “110,112” should read -- 110, 112 --.
Line 46, “122,126” should read -- 122, 126 --.

Column 5,
Line 36, “maybe” should read -- may be --.

Column 8,
Lines 30 and 38, “passageway” should read -- passageways --.

Signed and Sealed this

Tenth Day of May, 2005

JON W. DUDAS
*Director of the United States Patent and Trademark Office*

US006793574C1

(12) INTER PARTES REEXAMINATION CERTIFICATE (948th)

United States Patent

Robinson

(10) Number: US 6,793,574 C1

(45) Certificate Issued: Aug. 27, 2014

(54) VENT WITH PRESECURED MECHANICAL FASTENERS

(75) Inventor: Larry Dwight Robinson, Taylorsville, MS (US)

(73) Assignee: Keybank National Association, Cleveland, OH (US)

Reexamination Request:
No. 95/001,952, Mar. 29, 2012

Reexamination Certificate for:

| | |
|---|---|
| Patent No.: | **6,793,574** |
| Issued: | **Sep. 21, 2004** |
| Appl. No.: | **10/600,397** |
| Filed: | **Jun. 20, 2003** |

Certificate of Correction issued May 10, 2005

(51) Int. Cl.
*F24F 7/02* (2006.01)

(52) U.S. Cl.
USPC ..... 454/365; 454/364; 52/199

(58) Field of Classification Search
None
See application file for complete search history.

(56) References Cited

To view the complete listing of prior art documents cited during the proceeding for Reexamination Control Number 95/001,952, please refer to the USPTO's public Patent Application Information Retrieval (PAIR) system under the Display References tab.

*Primary Examiner* — Peter C. English

(57) ABSTRACT

A vent which is attachable but not attached to a structure includes a body having openings for passage of air therethrough while resisting undesired entry of foreign matter. The body has a plurality of fastener receiving passageways. Passageways have an entry end and an exit end and fasteners extend into the passageways for retention therein prior to securement of the vent to the structure. The passageways are preferably composed of a resilient material and the passageway opening has at least portions of lesser opening size than the average diameter of the shank of the fasteners such as nails. In another embodiment, the passageways may be composed of a suitable metal. The passageway may have radially inwardly projecting portions which define a generally triangular segmented surface for retention of the fastener. The vent may be a roof ridge ventilator or other type of vent. The ventilator with the preattached fasteners may be shipped to the ultimate installation site in this manner thereby eliminating the need for the installer to separately handle and position each nail.

At the time of issuance and publication of this certificate, the patent remains subject to pending reissue application number 14/023,743 filed Sep. 11, 2013. The claim content of the patent may be subsequently revised if a reissue patent is issued from the reissue application.

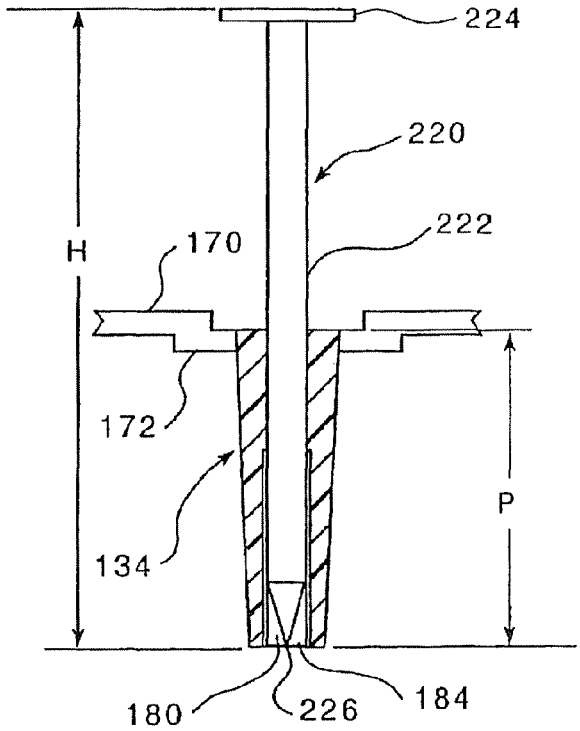

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-22 are cancelled.

* * * * *